US010316441B2

(12) United States Patent
Ly

(10) Patent No.: US 10,316,441 B2
(45) Date of Patent: Jun. 11, 2019

(54) FOOTWEAR ARTICLE INCLUDING CIRCULAR KNIT STRUCTURES

(71) Applicant: The North Face Apparel Corp., Wilmington, DE (US)

(72) Inventor: John Ly, Oakland, CA (US)

(73) Assignee: The North Face Apparel Corp., Wilmington, DE (US)

( * ) Notice: Subject to any disclaimer, the term of this patent is extended or adjusted under 35 U.S.C. 154(b) by 224 days.

(21) Appl. No.: 15/382,001

(22) Filed: Dec. 16, 2016

(65) Prior Publication Data

US 2018/0168271 A1 Jun. 21, 2018

(51) Int. Cl.

| | |
|---|---|
| ***D04B 1/26*** | (2006.01) |
| ***D04B 7/32*** | (2006.01) |
| ***D04B 9/46*** | (2006.01) |
| ***A43B 1/04*** | (2006.01) |
| ***D04B 1/10*** | (2006.01) |
| ***D04B 1/12*** | (2006.01) |
| ***A43B 23/02*** | (2006.01) |
| ***A43B 23/04*** | (2006.01) |

(52) U.S. Cl.

CPC ..... *D04B 1/26* (2013.01); *A43B 1/04* (2013.01); *A43B 23/0235* (2013.01); *A43B 23/042* (2013.01); *D04B 1/108* (2013.01); *D04B 1/123* (2013.01); *D04B 7/32* (2013.01); *D04B 9/46* (2013.01); *D10B 2403/023* (2013.01); *D10B 2501/043* (2013.01)

(58) Field of Classification Search

CPC ... D04B 1/26; D04B 7/32; D04B 9/46; D04B 9/54; A43B 1/04; A43B 23/02; A43B 23/04

See application file for complete search history.

(56) References Cited

U.S. PATENT DOCUMENTS

| | | | | |
|---|---|---|---|---|
| 3,259,915 A * | 7/1966 | Dison | ..... | A41B 11/005 2/239 |
| 3,796,067 A * | 3/1974 | East | ..... | A41B 11/005 66/178 R |
| 4,341,096 A * | 7/1982 | Safrit | ..... | A41B 11/005 2/239 |

(Continued)

FOREIGN PATENT DOCUMENTS

| | | |
|---|---|---|
| EP | 2805638 | 11/2014 |
| WO | 2016/009115 | 1/2016 |
| WO | 2018/017854 | 1/2018 |

*Primary Examiner* — Danny Worrell

(74) *Attorney, Agent, or Firm* — Smith, Gambrell & Russell LLP

(57) ABSTRACT

An aspect of the disclosure is a footwear article. The footwear article includes a double layer knitted upper having a foot bed, an upper portion continuous with the foot bed, an ankle opening, and an inner void for receiving a foot of a wearer. The double layer knitted upper has an outer knit layer defining an exterior surface of the double layer knitted upper. The double layer knitted upper also has an inner knit layer monolithically knit to the outer knit layer. The inner knit layer has a plurality of inner knit regions that spatially correspond to the plurality of outer knit regions of the outer knit layer. The outer knit layer and the inner knit layer substantially define the foot bed and the upper portion of the double layer knitted upper.

20 Claims, 6 Drawing Sheets

(56) References Cited

U.S. PATENT DOCUMENTS 4,467,626 A * 8/1984 Coble ..... A41B 11/005 66/178 R
4,958,507 A * 9/1990 Allaire ..... A41B 11/005 66/172 E
5,226,194 A * 7/1993 Staley ..... A41B 11/005 2/239
5,675,992 A * 10/1997 Wrightenberry ..... A41B 11/005 2/239
5,778,702 A * 7/1998 Wrightenberry ..... A41B 11/005 2/239
6,550,289 B1 * 4/2003 Higgins ..... A41B 11/005 2/239
6,612,136 B2 * 9/2003 Roe ..... A41B 11/005 66/178 R
6,862,902 B1 * 3/2005 Kim ..... A41B 11/005 66/178 R
6,931,762 B1 8/2005 Dua
6,986,269 B2 1/2006 Dua
6,990,755 B2 1/2006 Hatfield et al.
7,171,767 B2 2/2007 Haffield et al.
7,213,420 B2 * 5/2007 Lynch ..... A41B 11/005 66/186
7,347,011 B2 3/2008 Dua et al.
7,392,605 B2 7/2008 Hatfield et al.
7,637,032 B2 12/2009 Sokolowski et al.
7,774,956 B2 8/2010 Dua et al.
7,814,598 B2 10/2010 Dua et al.
7,849,609 B2 12/2010 Edington et al.
8,028,440 B2 10/2011 Sokolowski et al.
8,042,288 B2 10/2011 Dua et al.
8,196,317 B2 6/2012 Dua et al.
8,215,132 B2 7/2012 Dua et al.
8,225,530 B2 7/2012 Sokolowski et al.
8,266,749 B2 9/2012 Dua et al.
8,745,895 B2 6/2014 Sokolowski et al.
8,800,172 B2 8/2014 Dua et al.
8,881,430 B2 11/2014 Seamarks et al.
8,898,932 B2 12/2014 Woodman et al.
8,959,800 B2 2/2015 Sokolowski et al.
8,959,959 B1 2/2015 Podhajny
9,365,960 B2 * 6/2016 Craig ..... D04B 1/26
9,675,134 B2 * 6/2017 Kosui ..... D04B 1/22
2003/0033837 A1 * 2/2003 Higgins ..... A41B 11/005 66/178 R
2003/0089136 A1 * 5/2003 Lynch ..... A41B 11/005 66/187
2007/0094892 A1 5/2007 Craig et al.
2011/0078921 A1 4/2011 Greene et al.
2011/0277218 A1 11/2011 Padilla
2012/0266362 A1 * 10/2012 Craig ..... D04B 1/26 2/239
2013/0247415 A1 9/2013 Kohatsu
2014/0137433 A1 5/2014 Craig
2014/0137434 A1 5/2014 Craig
2014/0150292 A1 6/2014 Podhajny et al.
2014/0202042 A1 7/2014 Berend et al.
2014/0245633 A1 9/2014 Podhajny
2014/0245634 A1 9/2014 Podhajny
2014/0352173 A1 12/2014 Bell et al.
2014/0352179 A1 12/2014 Bell et al.
2015/0059209 A1 3/2015 Dekovic et al.
2015/0107307 A1 * 4/2015 Kosui ..... D04B 1/22 66/177
2015/0230544 A1 8/2015 Bacino
2016/0066651 A1 * 3/2016 Terai ..... D04B 1/24 36/45

* cited by examiner

FOOTWEAR ARTICLE INCLUDING CIRCULAR KNIT STRUCTURES

TECHNICAL FIELD

The present disclosure relates to a footwear article that includes circular knit structures and a method of making such footwear articles.

BACKGROUND

Conventional footwear articles have a sole and an upper attached to the sole. Footwear manufacturing has historically been a cut-sew-assembly operation that is labor intensive. Panels of upper materials are cut to size and sewn together to create the upper. The sole is attached to the upper using a number of different techniques to create the finished footwear article. Recent developments in footwear design employ knitting technology to form portions of footwear and the upper in particular. In some instances, flat bed knitting is used to form a planar knitted fabric blank. The planar knitted fabric blank is formed into a specific shape so that it can be folded or wrapped into a near completed shoe upper. Once the upper is formed, the sole component or other durable structures are attached to the knitted shoe upper consistent with conventional footwear manufacturing techniques. While some sewing is required to create the shoe upper using flat-bed knitting, fewer sewing steps are required compared to conventional shoe manufacturing. Although flat knitting may result in increased material utilization, because fabric cutting in minimized, there are design limits and production inefficiencies inherent in flat knitting.

SUMMARY

An embodiment of the present disclosure is a footwear article, knitted blank, and a method for making a footwear article and a knitted blank. The footwear article includes a double layer knitted upper having a foot bed, an upper portion continuous with the foot bed, an ankle opening, and an inner void for receiving a foot of a wearer. The double layer knitted upper has an outer knit layer defining an exterior surface of the double layer knitted upper. The double layer knitted upper also has an inner knit layer monolithically knit to the outer knit layer. The inner knit layer has a plurality of inner knit regions that spatially correspond to the plurality of outer knit regions of the outer knit layer. The outer knit layer and the inner knit layer substantially define the foot bed and the upper portion of the double layer knitted upper.

DETAILED DESCRIPTION OF EMBODIMENTS

Embodiments of the present disclosure include a footwear article that includes a circular knitted fabric formed into a double-layer knitted upper of a footwear article 10. The footwear article 10 is disclosed as having a configuration suitable for walking or running. Concepts associated with the footwear may also be applied to a variety of other athletic footwear types, including baseball shoes, basketball shoes, cross-training shoes, cycling shoes, football shoes, tennis shoes, soccer shoes, sprinting shoes, and hiking boots, for example. The concepts may also be applied to footwear types that are generally considered to be non-athletic, including dress shoes, loafers, sandals, and work boots. The concepts disclosed in this application apply to a wide variety of footwear types.

Figure 1:
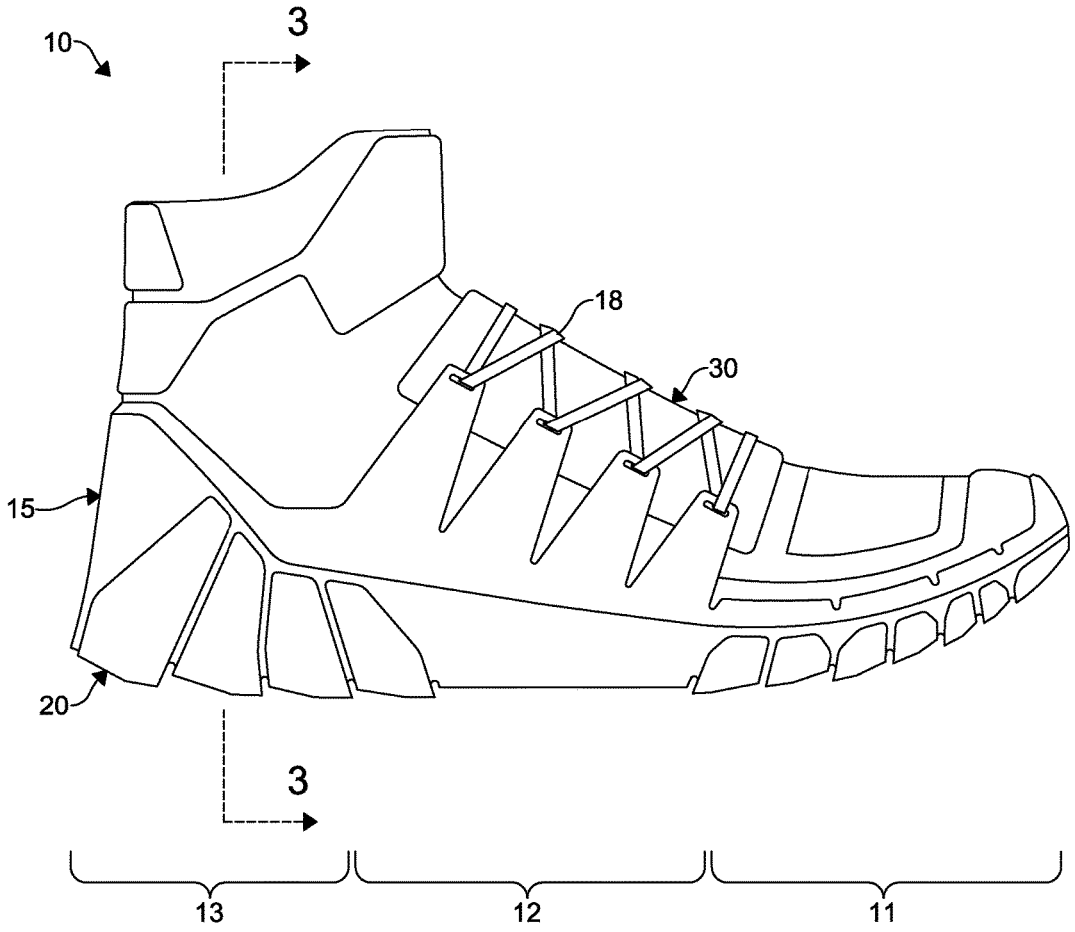
FIG. 1 is a side elevation view of a footwear article according to an embodiment of the present disclosure.
Figure 2:
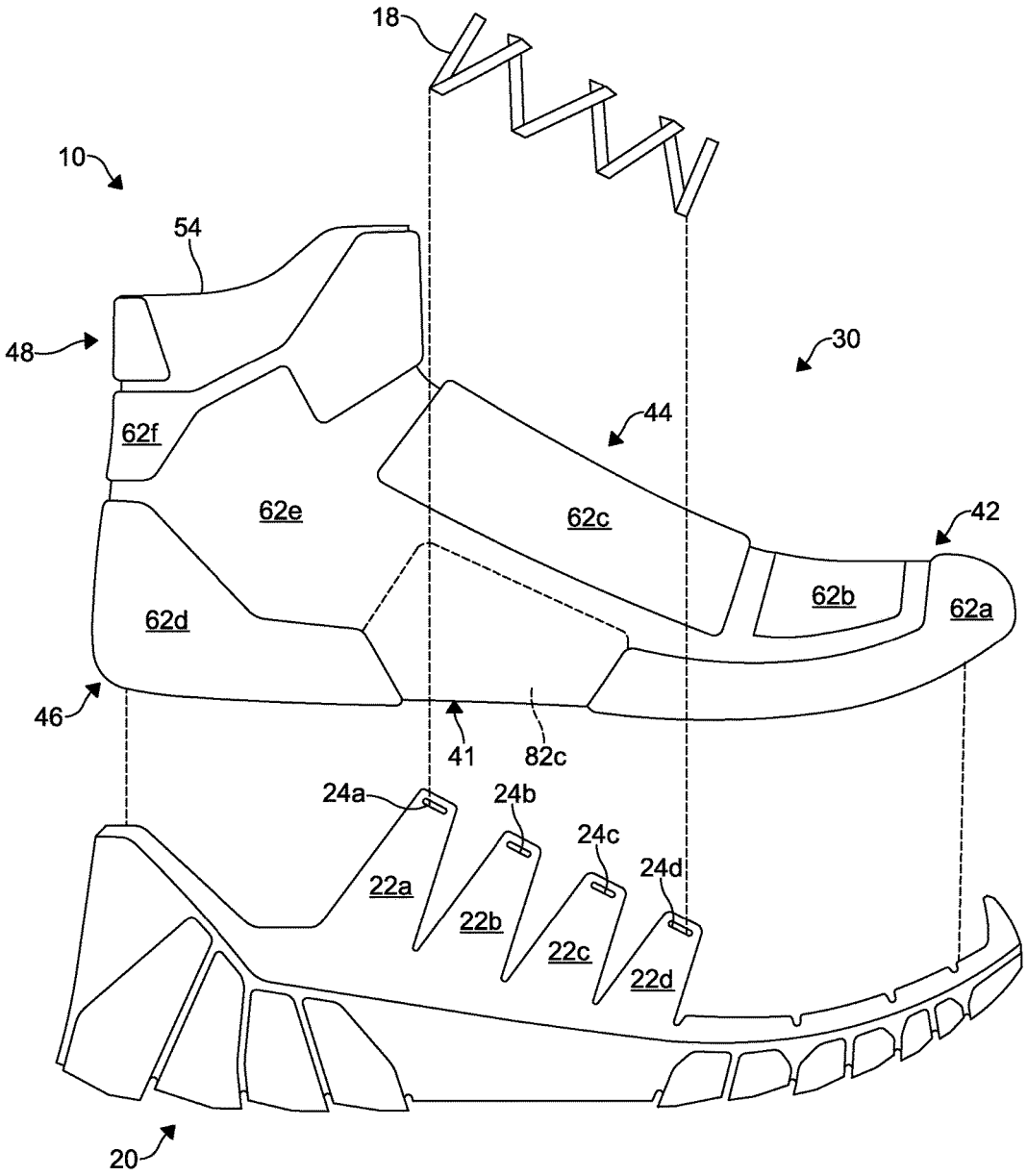
FIG. 2 is an exploded view of the footwear article shown in FIG. 1.
Figure 3:
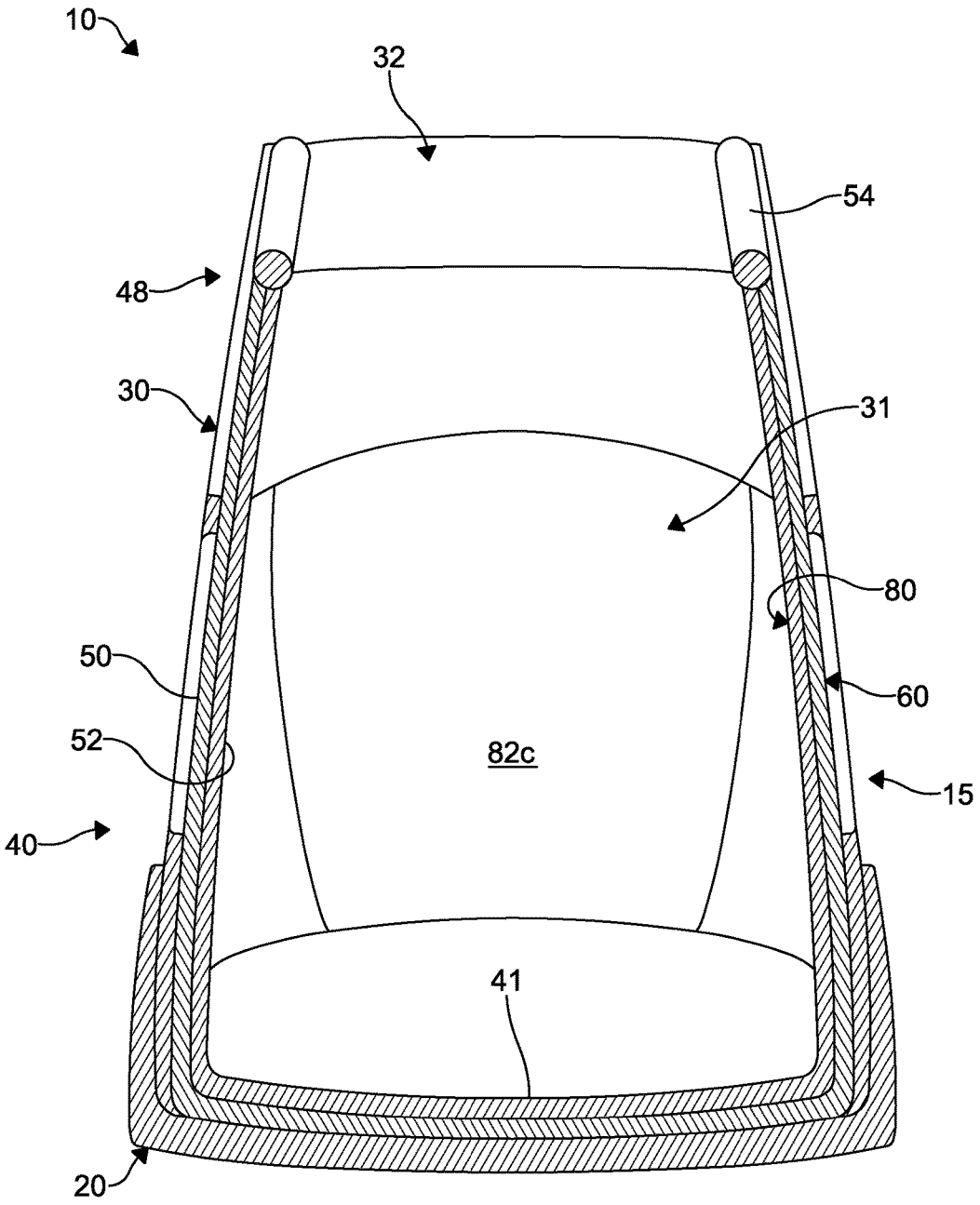
FIG. 3 is a cross-sectional view of the footwear article taken along line 3-3 in FIG. 1.

Referring to FIGS. 1-3, a footwear article 10 includes a sole component 20 and an upper knitted component 30. For reference purposes, footwear article 10 may be divided into three general regions: a forefoot region 11, a midfoot region 12 rearward of the forefoot region, and a heel region 13. The forefoot region 11 generally includes portions of footwear article 10 corresponding with the toes and the joints connecting the metatarsals with the phalanges, The midfoot region 12 generally includes portions of footwear article 10 corresponding with an arch area of the foot, The heel region 13 generally corresponds with rear portions of the foot. The footwear article 10 also includes a medial side 14 and a lateral side 15, which extend through each of the regions 11-13 and correspond with opposite sides of footwear article 10. The lateral side 15 corresponds with an outside area of the foot, i.e. the surface that faces away from the other foot, and the medial side 14 corresponds with an inside area of the foot, i.e., the surface that faces toward the other foot. Regions 11-13 and sides 14-15 are intended to represent general areas of footwear article 10. In addition to footwear article 10, regions 11-13 and sides 14-15 may also be applied to sole component 20 and/or the upper knitted component 30.

Continuing with FIGS. 1-3, the sole component 20 is secured to the upper knitted component 30 and extends between the foot and the ground when footwear article 10 is worn. The sole component 20 may include a midsole, an outsole, and a liner (not shown). The midsole is secured to the upper knitted component 30, as further explained below. The mid-sole may be formed from a compressible polymer foam element, e.g., a polyurethane or ethylvinylacetate foam, that attenuates ground reaction forces and provides cushioning when compressed between the foot and the ground during walking, running, or other ambulatory activities. The outsole is secured to a lower surface of midsole and may be formed from a wear-resistant rubber material that is textured to impart traction. The structure and features of sole component 20 or any sole component utilized with upper knitted component 30 may vary considerably.

The footwear article 10 includes a plurality of tabs 22*a*-22*d* that extend upwardly from the sole component 20 along a medial side 14 and a lateral side 15 of the footwear article 10. The plurality of tabs 22*a*-22*d* include securing members 24*a*-24*d* in the form of openings, slots, and/or hooks that receive a cord 18.

Continuing with FIGS. 1-3, the upper knitted component 30 forms an internal void 31 within footwear article 10 for receiving and securing a foot relative to sole component 20. The void 31 is shaped to accommodate the foot and extends along the lateral side of the foot, along the medial side of the foot, over the foot, around the heel, and under the foot. Access to the void is provided by an ankle opening 32 located in at least heel region 13. A cord 18 extends through portions of upper knitted component 30, as described above, and permits the wearer to modify dimensions of the upper knitted component 30 to accommodate the proportions of the foot. The cord 18 permits the wearer to tighten the upper knitted component 30 around the foot, and cord 18 permits the wearer to loosen the upper knitted component 30 to facilitate entry and removal of the foot from the void 31 through ankle opening 32.

Continuing with FIGS. 1-3, the upper knitted component 30 is a double layer knitted upper having a substantially monolithic, circular knit, fabric construction. The double layer knitted upper has a foot bed 41, a toe portion 42, a mid-foot portion 44 (sometimes called an upper portion 44) continuous with the toe portion 42, a heel portion 46 adjacent and continuous with the mid-foot portion 44 and an ankle portion 48 that defines the ankle opening 32. The foot bed 41 extends from the toe portion 42 along the mid-foot portion 44 to the heel portion 46. The sole component 20 is attached to the foot bed 41. In an alternative embodiment, a liner (not shown) is positioned within the double layer knitted upper along the foot bed 41. The toe portion 42, mid-foot portion 44, heel portion 46, and ankle portion 48, and foot bed 41 refer to generally areas of the upper knitted component 30.

Referring to FIGS. 2 and 3, the double layer knitted upper has an outer knit layer 60 and an inner knit layer 80. The outer knit layer 60 and the inner knit layer 80 together form the toe portion 42, the mid-foot portion 44, the heel portion 46, and the ankle portion 48 of the double layer knitted upper. The outer knit layer 60, however, defines an exterior surface 50 of the double layer knitted upper and the inner knit layer defines an inner surface 52 of the double-layer knitted upper. Thus, it can be said that the outer knit layer 60 forms the exterior facing surfaces (not numbered) of the toe portion 42, the mid-foot portion 44, the heel portion 46, and the ankle portion 48. Conversely, the inner knit layer 80 defines the inward facing surfaces (not numbered) of the toe portion 42, the mid-foot portion 44, the heel portion 46, and the ankle portion 48. Furthermore, both the outer knit layer 60 and the inner knit layer 80 substantially define the foot bed 41 of the double-layer knitted upper. The outer knit layer 60 and the inner knit layer 80 may define an edge 51 along the ankle opening 32. An optional binding 54 may be disposed along the edge 51 of the ankle opening 32.

The double layer knitter upper include at least one attachment member that consolidates the outer knit layer 60 to the inner knit layer 80, thereby forming the double layer knitted upper. The attachment member may be any material that fuses the outer knit layer 60 and the inner knit layer 80 together. Because the outer and inner knit layers are circular knit structure, each layer has float yarns on side due to the different knit constructions formed in the knitted regions described below. When the double layer knitter upper is formed the floats from the outer knit layer 60 face the floats from the inner knit layer 80. The floats can create snags and deform the knit construction when the floats are pulled or the layers or otherwise deformed. The attachment members address this problem by consolidating the outer knit layer and the inner knit layer together. In particular, the attachment member bonds the yarns from the outer knit layer 60 to the yarns from the inner knit layer 80. This bonding minimizes distortion in the knit structure created in use. The attachment members also bind the outer and inner knit layers together so that the two layers do not slide relative to one another. The attachment member provides stability to the double layer knitted upper. In one example, the attachment member may comprise binding yarns. The binding yarns may comprise part of the knit stitches, may be laid-in, or plated in during knitting. When the binding yarns exposed to a desired temperature (at above glass transition temperature), the binding yarns melt, thereby consolidating the outer and inner knit layers 60, 80 together. The binding yarns may be thermoplastic polyurethane yarns. In another example, the binding yarns are low-melt thermoplastic yarns that have a lower melt temperature than the yarns used to form the outer and inner knit layers 60, 80. In an alternative embodiment, the attachment member may be a low-melt adhesive film, a low melt adhesive nonwoven web, or an adhesive coating. In still another alternative embodiment, the attachment member could be binding yarns that tack the outer layer and inner layer together.

The outer knit layer 60 has plurality of outer knit regions 62*a*-62*f* and the inner knit layer 80 has a plurality of inner knit regions 82*a*-82*g*. The outer and inner knit regions comprise selected textile structural elements. The selected textile structural elements may include specific knit stiches and/or presence of certain yarns. Furthermore, the selected textile structural elements may include the absence of certain knit stiches and/or yarns. One or more of the plurality of outer knit regions 62*a*-62*f* of the outer knit layer 60 may spatially correspond to one or more of the plurality of inner knit regions 82*a*-82*g*. In embodiments where the inner knit regions spatially correspond to the outer knit regions, the inner knit regions completely or partially underlie the outer knit regions. For example, each one of the inner knit regions 82*a*-82*e* underlie the respective outer knit regions 62*a*-62*d*. However, the outer knit layer 60 and the inner knit layer 80 may comprise different knit regions in different locations from the other.

FIG. 2 illustrates the plurality of outer knit regions 62*a*-62*f*. As illustrated, the plurality of outer knit regions comprise a first outer knit region 62*a* along the toe portion 42 and a portion of the foot bed 41. The first outer knit region 62*a* may be called a forward toe knit region. A second outer knit region 62*b* extends across the top of the toe portion 42. The second outer knit region 62*b* may be called an upper toe knit region. A third outer knit region 62*c* extends across the top part of the mid-foot portion 44 and rearward of the toe portion 42. The third outer knit region 62*c* may be called an upper mid-sole knit region. A fourth outer knit region 62*d* extends across heel portion 46. The fourth region 62*d* is referred to as an outer heel region. A fifth outer knit region 62*e* forms the remaining areas of the outer knit layer. A sixth outer knit region 62*f* is located along the ankle portion 48 above the outer heel portion 46. Each outer knit region 62*a* through 62*f* may have different textile structural elements, in terms of knit structure and/or yarns. Alternatively, each outer knit regions 62*a*-62*f* may have similar knit constructions, in terms of knit structure and/or yarns. In one example, the upper mid-sole knit region 62*c* may comprise binding yarns. Binding yarns may be, for example, thermoplastic polyurethane yarns. The binding yarns may facilitate consolidating the outer and inner knit layers 60, 80 together.

Figure 4:
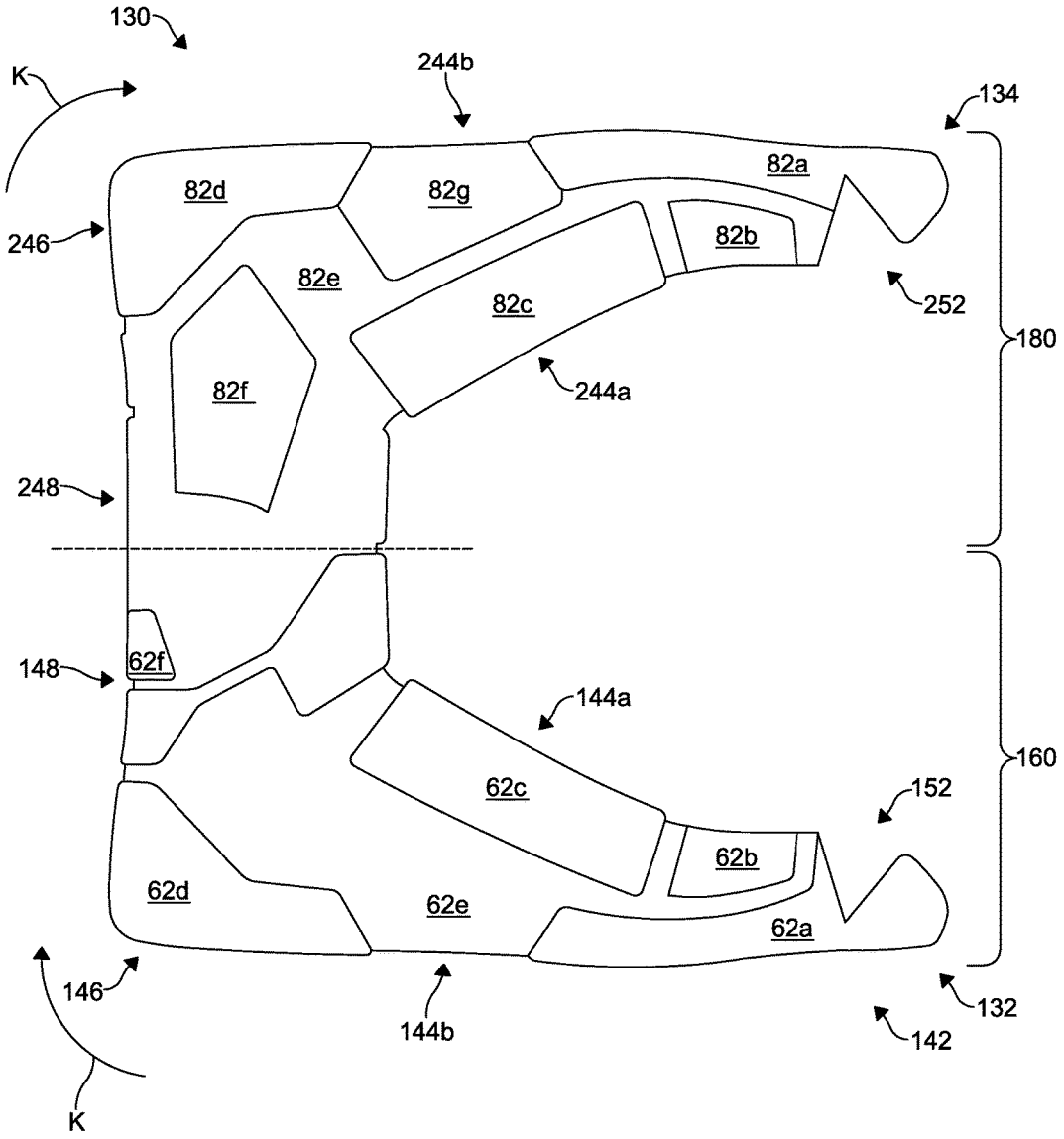
FIG. 4 is a side view of a knitted blank used to form a component of the footwear article illustrated in FIGS. 1-3.

As best shown in FIGS. 2 and 4, the inner knit layer 80 includes a plurality of inner knit regions 82*a*-82*g* that comprise selected textile structural elements. Regions 82*a*-82*g* are not shown in FIG. 2 but are illustrated in FIG. 4 as part of the knitted blank 130. As illustrated, the plurality of inner knit regions include a first inner knit region 82*a* along the toe portion and a portion of the foot bed. The first inner knit region 82*a* may be called a forward toe knit region. A second inner knit region 82*b* extends across the top of the toe portion. The second inner knit region 82*b* may be called an upper toe knit region. A third inner knit region 82*c* extends across the top part of the mid-sole portion and rearward of the toe portion. The third inner knit region 82*c* may be called an upper mid-sole knit region. A fourth inner knit region 82*d* extends across the heel portion. The fourth region 82*d* is referred to as an inner heel region. A fifth inner knit region 82*e* forms the remaining areas of the inner knit layer 80. A sixth inner knit region 82*g* extends across the bottom part of the mid-sole portion and rearward of the toe portion. The sixth inner knit region 82*g* may be called a lower mid-sole knit region 82*g*. A seventh inner knit region 82*f* is located along the ankle portion. Each inner knit region 82*a* through 82*g* may have different textile structural elements, in terms of knit structure and/or yarns. Alternatively, each inner knit regions 82*a*-82*g* may have similar knit constructions, in terms of knit structure and/or yarns. In one example, the upper mid-sole knit region 82*c* and/or the lower mid-sole knit region 82*g* may comprise binding yarns. Binding yarns may be thermoplastic polyurethane yarns, as described above. Binding yarns may facilitate consolidating the outer and inner knit layers 60, 80 together.

The double layer knitted upper can have a variety of circular knit constructions. For instance, the double layer knitted upper may have include a single jersey knit construction, a double knit construction, rib knit construction, a terry knit construction, or other types of weft knit constructions. Furthermore, the different regions of the double layer knitted upper may comprise different knit stitches, such as float stiches, held stiches, missed stiches, and other knit stiches known to a person of skill in the art. In one example, the outer knit toe regions 62*a*, 82*a* of the outer and/or inner layer may comprise a cushioned knit construction. Likewise, the heel regions 62*d*, 82*d* of the outer and/or inner layer can have cushioned knit construction. A cushioned knit construction includes knitted terry loops.

The double layer knitted upper can be formed from any number of yarn types, such as spun yarns or continuous filament yarns. Spun yarns may include natural fibers, synthetic fibers, or blends of natural and synthetic fibers. Natural fibers include cotton, wool, bamboo, flax, hemp, or others. Synthetic fibers may include polyethylene terephthalate (PET), polyolefin, polyamide 6, polyamide 6,6, polylactic acid (PLA) fibers, viscose rayon, acrylic, or other fiber types. Suitable thermoplastic synthetic staple fibers may be mono-component or bi-component type fibers. A variety of yarn spinning types can be used, such as ring spun, open end, air-jet, compact spinning, and the like. Continuous filament yarns may include either or both mono-component or bicomponent filaments types. Continuous filament yarns can be polyethylene terephthalate, polyolefin, and/or polyamide 6, polyamide 6,6, polylactic acid filaments. Yarns used in the knit fabric can have a range of yarn counts. For instance, in one example, the knit yarn can have a count in a range between about 50 denier to about 250 denier (or higher). The yarns are not limited to the stated range of deniers. Binding yarns are used in selected regions of the outer knitted layer 60 and the inner knitted layer 80 to help consolidate the outer layer and the inner layers together. Binding yarns may be low melt thermoplastic yarns, or yarns such as thermoplastic polyurethane yarns.

Figure 5:
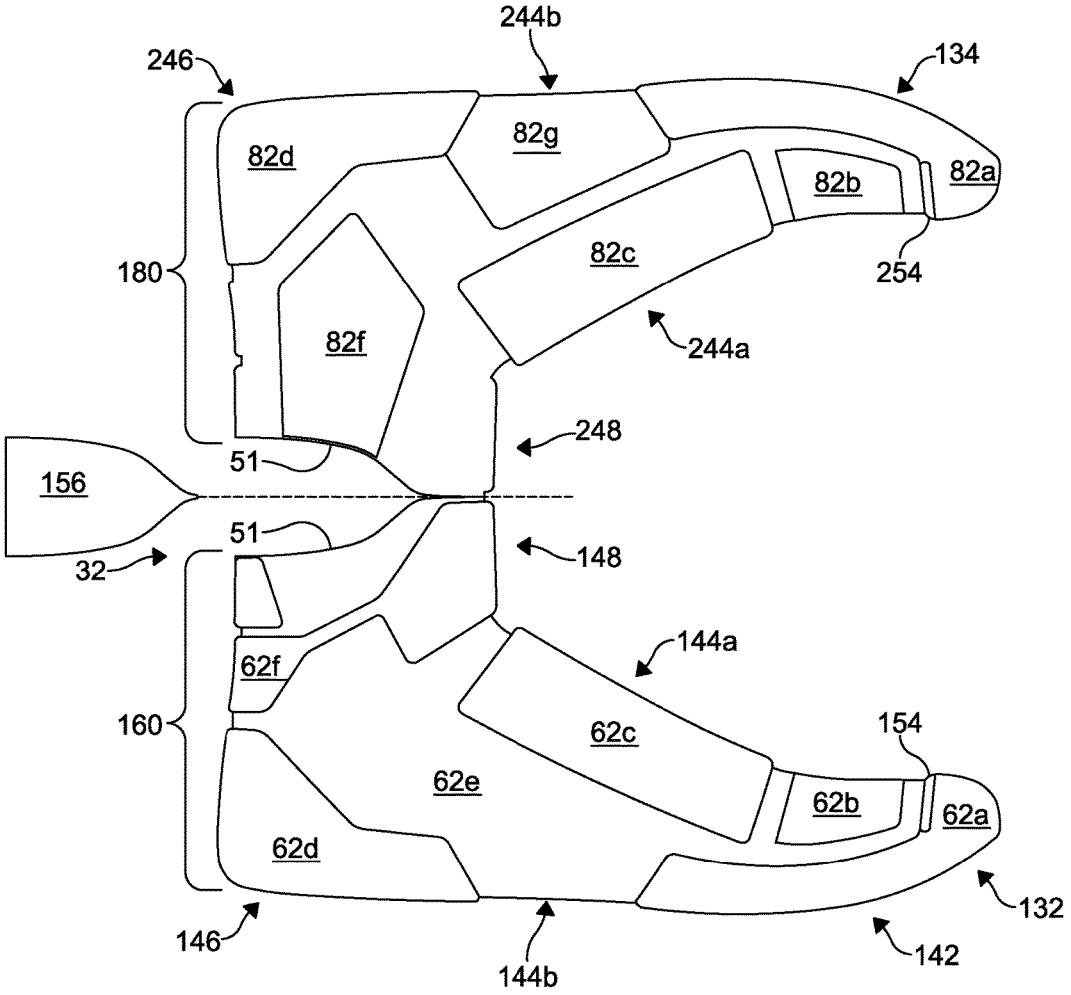
FIG. 5 is a side view of an interior of the knitted blank used to form the component of the footwear article illustrated in FIGS. 1 and 2, showing portion of the knitted blank removed to create an ankle portion of the footwear article.
Figure 6:
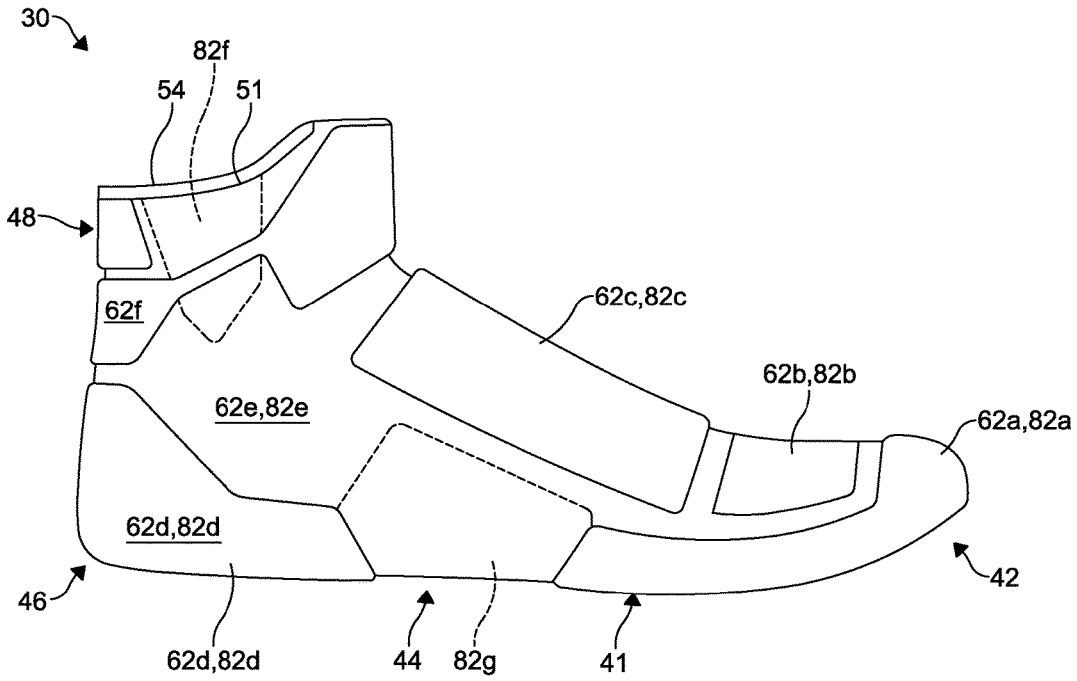
FIG. 6 is a side elevation view of a double layer knitted footwear component formed from the knitted blank shown in FIG. 4.

Another embodiment of the present disclosure is a method for forming a footwear article 10. The method may include a knitting phase form forming a circular knitted blank 130. Following the knitting phase, the method may include an assembling phase where the circular knitted blank 130 is formed into an upper knitted component 30 and the sole component 20 is attached to foot bed 41 of the upper knitted component 30. Referring to FIGS. 4-6, the The circular knitted blank 130 that has a first knit section 160 defining the outer knit layer 60 and the second knit section 180 defining the inner knit layer 80. The circular knitted blank 130 is folded into to itself to define the double layer knitted upper so that the inner knit layer 80 forms the inner void 31 of the footwear article 10.

The knitting phase utilizes a circular knitting machine (not shown) familiar to a person of skill in the art. The circular knitting machine may be a double needle machine that includes two cylinders. Alternatively, a circular knitting machine with a cylinder and a dial may be used. The knitting process is described below using a knitting machine with two cylinders for purposes of illustration and clarity. It should be appreciated that other types of knitting machines could be used. Each cylinder has a plurality of needles disposed around the circumference of the cylinder with each needle housed in moveable tracks. A cam assembly engages the needles along each cylinder. Rotational movement of the cam assembly (or relative movement of the cylinders) causes the needles to move up and down the tracks through what is known in the art as the knitting cycle to create courses of interconnected knitted loops of yarns. The courses of knitted loops define the circular knitted fabric blank 130. By altering the knitting cycles and/or holding certain needles in place during knitting, specific knit stitches and/or patterns can be formed into the circular knitted blank 130. The circular knitting machines and the basic circular knitting process is familiar to a person of skill in the art. Various circular knit processes may be used, such as tube circular knitting, narrow tube circular knit jacquard, single knit circular knit jacquard, double knit circular knit jacquard knitting.

Referring to FIG. 4, the circular knitted blank 130 has a first terminal end 132 and a second terminal end 134. The circular knitted blank 130 is formed to have a first knit section 160 that defines the first terminal end 132 and a second knit section 180 that defines the second terminal end 134. The circular knitted blank 130 is comprised of interconnected rows of knitted loops, called courses, as described above. The first "course" of the knitted blank 130 is located at the first terminal end 132. The circular knitted blank 130 is formed course-by-course, in the direction K shown in FIG. 4 until the circular knitted blank 130 is complete, as shown in FIG. 4. Accordingly, during the knitting phase, the first knit section 160 is knitted first, then the second knit section 180 is formed in a single monolithic fabric with the first knit section 160.

Circular knitting the fabric blank 130 initiates with the cylinder needles knitting the first toe portion 142 of the first knit section 160. Next, the circular knitting machine knits the mid-sole portion, which includes a first upper portion 144*a* and the first lower portion 144*b*. Then, the first heel portion 146 the first knit section 160 is knit adjacent to the first lower portion 144*b*. During the knitting the first heel portion 146, the knitting machine can selectively drop needles to alter the direction of knitting to form the desired curve of the first heel portion 146. After the first heel portion 148 is formed, the circular knitting machine knits the first ankle portion 148 of the first knit section adjacent 160 to the first heel portion 148 and the first upper portion 144*a*. At this point, the first knit section 160 is substantially complete. The first knit section 160 comprises the outer knit layer 60 of the double layer knitted upper, as explained below. Accordingly, as the knitting machine forms the first knit section 160, the different knit regions 62*a*-62*f* are created in the circular knitted fabric blank 130, as shown.

The knitting process continues to form the second knit section 180. During this phase of knitting, the second ankle portion 248 of the second knit section 180 is formed adjacent to the first heel portion 148. The circular knitting machines knits a second heal portion 246 adjacent to and continuous with the second ankle portion 248. The circular knitting machine knits a second upper portion 244*a* and a second lower portion 244*b* of the second knit section 180. The knitting process continues and forms the second toe portion 242 of the second knit section 180 adjacent to the second upper portion 244*a* and the second lower portion 244*b*. The second toe portion 242 is formed to the terminal end 134 to complete the knitted blank 130. As the knitting machines forms the second knit section 180, the different knit regions 82*a*-82*g* are created in respective areas of the circular knitted fabric blank 130. As illustrated, the formed circular knitted blank 130 is substantially a tubular structure having the shape of two crew-cut socks connected as the ankle portion.

Additional courses of yarns may be added to facilitate transition to the next knitted blank formed by the circular knitting machine. Optional cutting devices are used to cut the completed circular knitted blank 130 from the knitting machine. The circular knitted blank 130 is the ejected out of the knitting machines for later processing.

The completed circular blank 130 may have toe openings 152 and 252 at toe portion 142 and toe portion 242, respectively. The toe openings 152 and 252 can be closed with seams 154 and 254 as illustrated in FIG. 5. In an alternative embodiment, the circular knitted blank 103 can be formed to automatically close the toe openings 152 and 252 using bridge stiches or inlayed yarns and the like.

The circular blank 130 may be cut to form the ankle opening 32 by removing a panel 156 from the circular knitted blank 130. In an alternative embodiment, the circular knitted blank 103 can be formed to define the ankle opening 32 during knitting. In such an embodiment, the circular knitted blank 130 may form a welted edges along the border of the ankle opening 32 to prevent fraying and provide a place to attach a binding 54 (FIGS. 1 and 6).

When the circular knitted blank 130 is completed, the second knit section 180 is folded into the first knit section 160 to form a double layer knitted upper of the footwear article. At this stage, the double layer knitted upper comprises the outer knit layer 60 defined by the first knit section 160 and the inner knit layer 80 defined by the second knit section 180. In this state, at least two of the plurality of the outer knit regions 62*a*-62*d* of the outer knit layer 60 spatially correspond to at least two of the plurality of inner knit regions. In accordance with the illustrated embodiment, the inner knit regions 82*a*-82*e* underlie the outer knit regions 62*a*-62*e*.

The method may comprise, before folding, positioning a liner component along a lower portion of the first knit section. The liner component is therefore disposed between the outer knit layer and the inner knit layer.

The method may include attaching a sole directly to the outer knit layer of the double layer knitted upper. Attaching the sole to the outer knit layer comprises positioning the double layer knitted upper over a positioning member of an injection-molding device (not shown). Then, the sole component is injection molded onto the outer knit layer of the double layer knitted upper. In addition, the method may include injection molding a plurality of tabs 22*a*-22*d* along medial and lateral sides of the double layered knitted upper. The injection molding process may melt the TPU yarns in the specific knitted regions thereby bonding the outer knit layer to the inner knit layer to form a monolithic, double layer knitted upper.

Double layer knitted uppers that are circular knit as described herein have several advantages. A wide range of knit constructions across different regions of the upper is possible while using a single fabric construction. Specific knit structures can be designed into different regions of the footwear article as needed. In addition, complex three-dimensional shapes that better conform to the anatomy of the foot of the wearer may be formed during the knitting process. Because circular knitted uppers are made to conform to the foot of the wearer, fewer assembly steps are required prior to attaching the upper to the sole to create the finished footwear article. Fewer total components in the finished footwear article decreases supply chain complexity and increases production efficiency and output. Furthermore, circular knitted double layer uppers can be manufactured at relatively fast production rates further increasing production efficiency.

ASPECTS

The present disclosure includes at least the following aspects:

Aspect 1: A footwear article, comprising: a double layer knitted upper having a foot bed, an upper portion continuous with the foot bed, an ankle opening, and an inner void for receiving a foot of a wearer, the double layer knitted upper having:

a) an outer knit layer defining an exterior surface of the double layer knitted upper, the outer knit layer having a plurality of outer knit regions; and b) an inner knit layer monolithically knit to the outer knit layer, the inner knit layer forming the inner void, wherein the inner knit layer has a plurality of inner knit regions that spatially correspond to the plurality of outer knit regions of the outer knit layer, wherein the outer knit layer and the inner knit layer substantially define the foot bed and the upper portion of the double layer knitted upper; and a sole attached to at least the foot bed of the double layer knitted upper.

Aspect 2. The footwear article of aspect 1, further comprising a mid-sole positioned between the outer knit layer and the inner knit layer along the foot bed.

Aspect 3. The footwear article of aspect 1, wherein the outer knit layer and the inner knit layer is a monolithic circular knitted fabric.

Aspect 4. The footwear article of aspect 1, wherein the outer knit layer and the inner knit layer each define a tubular knitted shape.

Aspect 5. The footwear article of aspect 1, wherein the inner knit layer is monolithically knit to the outer knit layer around at least a portion of the ankle opening.

Aspect 6. The footwear article of aspect 5, wherein the outer knit layer and the inner knit layer define a welted edge along at least a portion of the ankle opening.

Aspect 7. The footwear article of aspect 1, wherein the outer knit layer and the inner knit layer include a binding along at least a portion of the ankle opening.

Aspect 8. The footwear article of aspect 1, further comprising at least one attachment member that consolidates the outer knit layer and the inner knit layer together.

Aspect 9. The footwear article of aspect 8, wherein at least one attachment member bonds yarns of the outer knit layer to yarns of the inner knit layer.

Aspect 10. The footwear article of aspect 8, wherein the at least one attachment member are binding yarns.

Aspect 11. The footwear article of aspect 10, wherein the binding yarns are thermoplastic polyurethane yarns.

Aspect 12. The footwear article of aspect 10, wherein the binding yarns are low-melt thermoplastic yarns.

Aspect 13. The footwear article of aspect 10, wherein the outer knit layer comprises first yarns, the inner knit layer comprises second yarns, and wherein the binding yarns have a lower melting temperature than the first yarns and the second yarns.

Aspect 14. The footwear article of aspect 8, wherein the at least one attachment member is an adhesive film.

Aspect 15. The footwear article of aspect 8, wherein the at least one attachment member is a low melt adhesive web.

Aspect 16. The footwear article of aspect 8, wherein at least one of the plurality of outer knit regions comprise the at least one attachment member.

Aspect 17. The footwear article of aspect 16, wherein the double layer knitted upper has a toe portion, wherein a first outer knit region of the plurality of outer knit regions in the outer knit layer extends across the upper portion rearward of the toe portion, wherein the first outer knit region comprises the at least one attachment member.

Aspect 18. The footwear article of aspect 8, wherein at least one of the plurality of inner knit regions comprise the at least one attachment member.

Aspect 19. The footwear article of aspect 18, wherein a second outer knit region of the plurality of outer knit regions extends across the toe portion, wherein a second inner knit region of the plurality of inner knit regions underlies the second outer knit region, wherein at least one of the second outer knit region and the second inner knit region comprises the at least one attachment member.

Aspect 20. The footwear article of aspect 18, wherein the plurality of inner knit regions includes an inner mid region along the foot bed that includes the at least one attachment member.

Aspect 21. The footwear article of aspect 1, wherein the double layer knitted upper has a heel portion that joins the foot bed to the ankle portion, wherein the heel portion has a cushioned knit construction.

Aspect 22. The footwear article of aspect 1, wherein the double layer knitted upper has a toe portion, wherein the toe portion has a cushioned knit construction.

Aspect 23. The footwear article of aspect 1, further comprising a plurality of tabs extending upwardly from the sole along a medial side and a lateral side of the footwear article.

Aspect 24. The footwear article of aspect 23, wherein the plurality of tabs include securing members that are configured to receive a cord.

Aspect 25. A circular knitted blank used to form an article of footwear and having a first terminal end and a second terminal end, the circular knitted blank comprising: a first circular knit section having a first toe portion defining the first terminal end of the circular knitted blank, a first upper portion, a first lower portion coupled to the first upper portion, a first heel portion, and a first ankle portion coupled to the first heel portion, wherein the first circular knit section has a first plurality of knit regions each having a different knit construction; and a second circular knit section having a second ankle portion that is monolithically knit to the first ankle portion, a second heel portion coupled to the second ankle portion, a second upper portion coupled to the second ankle portion, a second lower portion coupled to the second upper portion and the second heel portion, and a second toe portion defining the second terminal end of the circular knitted blank that is opposite to the first end of the circular knitted blank, wherein the second circular knit section includes a second plurality of knit regions each having a different knit construction; wherein the first plurality of knit regions correspond to the second plurality of knit regions, such that, when the first circular knit section is folded into the second circular knit section, the first plurality of knit regions and the second plurality of knit regions overly.

Aspect 26. The circular knitted blank of aspect 25, further comprising an opening located where the first ankle portion and the second ankle portion are joined.

Aspect 27. The circular knitted blank of aspect 25, further comprising at least one attachment member that is configured to bond the first circular knit section and the second circular knit section together.

Aspect 28. A method for forming a footwear article, comprising: circular knitting a tubular knitted blank having a first knit section and a second knit section, wherein a) the first knit section includes a first toe portion, a first lower portion, a first upper portion, a first heel portion adjacent to the first lower portion, and a first ankle portion adjacent to the first heel portion and the first upper portion, and b) the second knit section includes a second toe portion, a second lower portion, a second upper portion, a second heel portion adjacent to the second lower portion, and a second ankle portion adjacent to the second heel portion and the second upper portion; folding the first knit section into the second knit section to form a double layer knitted upper of the footwear article, the double layer knitted upper comprising an outer knit layer defined by the second knit section and an inner knit layer defined by the first knit section, wherein the inner knit layer defines an inner void of the double layer knitted upper; and attaching a sole directly to the outer knit layer of the double layer knitted upper.

Aspect 29. The method of aspect 28, wherein circular knitting includes, in sequence:

a. knitting the first toe portion of the first knit section;
b. knitting the first upper portion and the first lower portion of the first knit section;
c. knitting the first heel portion the first knit section adjacent to the first lower portion;
d. knitting the first ankle portion of the first knit section adjacent to the first heel portion and the first upper portion;
e. knitting the second ankle portion of the second knit section adjacent to the first heel portion;
f. knitting the second heel portion adjacent to the second ankle portion of the second knit section;
g. knitting the second upper portion and the second lower portion of the second knit section; and
h. knitting the second toe portion of the second knit section adjacent to the second upper portion and the second lower portion.

Aspect 30. The method of aspect 28, wherein attaching to sole to the outer knit layer comprises: positioning the double layer knitted upper over a positioning member of an injection molding device; injection molding the sole to the outer knit layer of the double layer knitted upper; and injection molding a plurality of tabs along medial and lateral sides of the double layered knitted upper, wherein the plurality of tabs are configured to receive a cord.

The present disclosure describes particular embodiments and their detailed construction and operation. The embodiments described herein are set forth by way of illustration only and not limitation. Those skilled in the art will recognize, in light of the teachings herein, that there may be a range of equivalents to the exemplary embodiments described herein. Most notably, other embodiments are possible. Variations can be made to the embodiments described herein, and there may be equivalents to the components, parts, or steps that make up the described embodiments. For the sake of clarity and conciseness, certain aspects of components or steps of certain embodiments are presented without undue detail where such detail would be apparent to those skilled in the art in light of the teachings herein and/or where such detail would obfuscate an understanding of more pertinent aspects of the embodiments.

What is claimed is:

1. A footwear article, comprising:

a double layer knitted upper having a foot bed, an upper portion continuous with the foot bed, an ankle opening, and an inner void for receiving a foot of a wearer, the double layer knitted upper having:

a) an outer knit layer defining an exterior surface of the double layer knitted upper, the outer knit layer having a plurality of outer knit regions; and b) an inner knit layer monolithically knit to the outer knit layer, the inner knit layer forming the inner void, wherein the inner knit layer has a plurality of inner knit regions each having a different knit construction that spatially correspond to the plurality of outer knit regions of the outer knit layer when folded into the outer knit layer, and wherein the outer knit layer and the inner knit layer is a monolithic circular knitted fabric, wherein the outer knit layer and the inner knit layer substantially define the foot bed and the upper portion of the double layer knitted upper; and a sole attached to at least the foot bed of the double layer knitted upper.

2. The footwear article of claim 1, further comprising a mid-sole positioned between the outer knit layer and the inner knit layer along the foot bed.

3. The footwear article of claim 1, wherein the outer knit layer and the inner knit layer each define a tubular knitted shape.

4. The footwear article of claim 1, wherein the inner knit layer is monolithically knit to the outer knit layer around at least a portion of the ankle opening.

5. The footwear article of claim 4, wherein the outer knit layer and the inner knit layer define a welted edge along at least a portion of the ankle opening.

6. The footwear article of claim 1, wherein the outer knit layer and the inner knit layer include a binding along at least a portion of the ankle opening.

7. The footwear article of claim 1, further comprising at least one attachment member that consolidates the outer knit layer and the inner knit layer together.

8. The footwear article of claim 7, wherein the at least one attachment member bonds yarns of the outer knit layer to yarns of the inner knit layer, and wherein the at least one attachment member is an adhesive film or a low melt adhesive web, or a combination of both.

9. The footwear article of claim 7, wherein at least one of the plurality of outer knit regions comprise the at least one attachment member.

10. The footwear article of claim 9, wherein the double layer knitted upper has a toe portion, wherein a first outer knit region of the plurality of outer knit regions in the outer knit layer extends across the upper portion rearward of the toe portion, wherein the first outer knit region comprises the at least one attachment member.

11. The footwear article of claim 7, wherein at least one of the plurality of inner knit regions comprise the at least one attachment member.

12. The footwear article of claim 11, wherein a second outer knit region of the plurality of outer knit regions extends across the toe portion.

wherein a second inner knit region of the plurality of inner knit regions underlies the second outer knit region, wherein at least one of the second outer knit region and the second inner knit region comprises the at least one attachment member.

13. The footwear article of claim 1, wherein the double layer knitted upper has a heel portion that joins the foot bed to the ankle portion, wherein the heel portion has a cushioned knit construction.

14. The footwear article of claim 1, wherein the double layer knitted upper has a toe portion, wherein the toe portion has a cushioned knit construction.

15. The footwear article of claim 1, further comprising a plurality of tabs extending upwardly from the sole along a medial side and a lateral side of the footwear article, wherein the plurality of tabs include securing members that are configured to receive a cord.

16. A circular knitted blank used to form an article of footwear and having a first terminal end and a second terminal end, the circular knitted blank comprising:

a first circular knit section having a first toe portion defining the first terminal end of the circular knitted blank, a first upper portion, a first lower portion coupled to the first upper portion, a first heel portion, and a first ankle portion coupled to the first heel portion, wherein the first circular knit section has a first plurality of knit regions each having a different knit construction; and a second circular knit section having a second ankle portion that is monolithically knit to the first ankle portion and an opening located where the first ankle portion and the second ankle portion are joined, a second heel portion coupled to the second ankle portion, a second upper portion coupled to the second ankle portion, a second lower portion coupled to the second upper portion and the second heel portion, and a second toe portion defining the second terminal end of the circular knitted blank that is opposite to the first end of the circular knitted blank, wherein the second circular knit section includes a second plurality of knit regions each having a different knit construction;

wherein the first plurality of knit regions correspond to the second plurality of knit regions, such that, when the first circular knit section is folded into the second circular knit section, the first plurality of knit regions and the second plurality of knit regions overly.

17. The circular knitted blank of claim 16, further comprising at least one attachment member that is configured to bond the first circular knit section and the second circular knit section together.

18. A method for forming a footwear article, comprising:

circular knitting a tubular knitted blank having a first knit section and a second knit section, wherein a) the first knit section includes a first toe portion, a first lower portion, a first upper portion, a first heel portion adjacent to the first lower portion, and a first ankle portion adjacent to the first heel portion and the first upper portion, wherein the first knit section has a first plurality of knit regions each having a different knit construction and b) the second knit section includes a second toe portion, a second lower portion, a second upper portion, a second heel portion adjacent to the second lower portion, and a second ankle portion adjacent to the second heel portion and the second upper portion, wherein the second knit section includes a second plurality of knit regions each having a different knit construction;

folding the first knit section into the second knit section to form a double layer knitted upper of the footwear article, the double layer knitted upper comprising an outer knit layer defined by the second knit section and an inner knit layer defined by the first knit section, wherein one or more of the wherein the inner knit layer defines an inner void of the double layer knitted upper, wherein the first plurality of knit regions correspond to the second plurality of knit regions, such that, when the first knit section is folded into the second knit section, the first plurality of knit regions and the second plurality of knit regions overly; and attaching a sole directly to the outer knit layer of the double layer knitted upper.

19. The method of claim 18, wherein circular knitting includes, in sequence:

a. knitting the first toe portion of the first knit section;

b. knitting the first upper portion and the first lower portion of the first knit section;

c. knitting the first heel portion the first knit section adjacent to the first lower portion;

d. knitting the first ankle portion of the first knit section adjacent to the first heel portion and the first upper portion;

e. knitting the second ankle portion of the second knit section adjacent to the first heel portion;

f. knitting the second heel portion adjacent to the second ankle portion of the second knit section;

g. knitting the second upper portion and the second lower portion of the second knit section; and h. knitting the second toe portion of the second knit section adjacent to the second upper portion and the second lower portion.

20. The method of claim 18, wherein attaching to sole to the outer knit layer comprises:

positioning the double layer knitted upper over a positioning member of an injection molding device;

injection molding the sole to the outer knit layer of the double layer knitted upper; and injection molding a plurality of tabs along medial and lateral sides of the double layered knitted upper, wherein the plurality of tabs are configured to receive a cord.

* * * * *